United States Patent [19]

Adams

[11] Patent Number: 4,856,305

[45] Date of Patent: Aug. 15, 1989

[54] OFFICE MACHINE SECURITY SYSTEM

[76] Inventor: Michael W. Adams, 1903 Hemmingway St., Canoga Park, Calif. 91306

[21] Appl. No.: 129,240

[22] Filed: Dec. 7, 1987

Related U.S. Application Data

[63] Continuation of Ser. No. 889,832, Jul. 28, 1986, abandoned.

[51] Int. Cl.[4] ..... E05B 73/00

[52] U.S. Cl. ..... 70/58; 70/164; 70/232

[58] Field of Search ..... 70/57, 58, 14, 18, 164, 70/229, 166–168, 230, 232; 411/82

[56] References Cited

U.S. PATENT DOCUMENTS

| | | | |
|---|---|---|---|
| 3,605,460 | 9/1971 | Singer et al. | 70/168 X |
| 3,744,282 | 7/1973 | Hemphill | 70/58 |
| 3,771,338 | 11/1973 | Raskin | 70/58 |
| 3,817,065 | 6/1974 | Sander | 70/232 |
| 3,910,079 | 10/1975 | Gassaway | 70/58 |
| 3,990,276 | 11/1976 | Shontz | 70/58 |
| 4,066,231 | 1/1978 | Bahner et al. | 70/229 X |
| 4,300,371 | 11/1981 | Herwick et al. | 70/58 |
| 4,357,814 | 11/1982 | Kripner | 70/232 |
| 4,462,194 | 7/1984 | Wahner | 411/82 |
| 4,493,577 | 1/1985 | Cosenza | 411/82 |

*Primary Examiner*—Robert L. Wolfe
*Assistant Examiner*—Suzanne L. Dino
*Attorney, Agent, or Firm*—Marvin E. Jacobs

[57] ABSTRACT

A security system that discourages thievery of office and work machines and the like from support furniture too difficult to asport, and comprised of a fastener enclosure and key operated bolt combination which involves the reception of a lock barrel into a housing for the enclosure of a tie-down fastener and secured by a lock barrel which is made difficult for unauthorized opening.

13 Claims, 2 Drawing Sheets

OFFICE MACHINE SECURITY SYSTEM

This is a continuation of Application Ser. No. 06/889,832, filed 07/28/86, now abandoned.

BACKGROUND OF THE INVENTION

The asportation of table-top machines is quite common, where such machines are movable, reference being made to the many office machines such as typewriters, calculators, computers and word processors etc. However, the combination of a bench, desk or table and such a machine secured thereto is too cumbersome for theft that would require quick and easy separation. That is, the inconvenience of moving large furnishings can be expected and does in fact discourage theft of such machines that are made part of heavy immovable office furnishings. Accordingly, this invention provides for locked attachment of machines and the like to larger furnishings such as desks and the like. With the present invention the equipment item is held to the furniture by a fastener enclosure secured by lock and key.

There are many variations in business machine design, but invariably there is a frame or housing for support upon a desk top or the like. For example, business machines are most often comprised of a frame with a flat bottom cover or base which has table-top support. The base serves mechanically as a support and closure, having a perimeter from which the machine housing continues for enclosing the mechanism with exposure of controls and other utilitarian features. The base or bottom cover closely overlies the table-top and is usually supported by corner legs or feet as is indicated. For security purposes, many business machines are provided with tie-down facility, having one or more openings in the bottom thereof for the reception of a mounting fastener. Thus, the machine can be secured to the desk top so as to be removable only with the use of tools. In practice, these fastener openings are threaded for the reception of a machine screw or bolt. However, there are such machines that have imperforate bottoms without tie-down facility, as later described.

It is a general object of this invention to provide a fastener enclosure for deterring theft of office machines and the like. As hereinabove stated, security of such equipment can be established by fastening them to heavy support furnishings. Accordingly, it is an object of this invention to enclose the tie-down fastener thereof under lock and key. With the present invention there is a lock barrel inserted as the closure of a housing, rendering the fastener inaccessible without a key.

A characteristic feature of this security system is that a fastener depends from the machine to be secured, so as to penetrate the desk top for the attachment of the security housing that I provide. Thus, attachment of this security housing is beneath the desk top where it is accessible. An object of this invention is to provide a security housing for the enclosure of a fastener, whereby the various types of screw fasteners are accomodated. That is, either a threaded end of or a headed end of a fastener is accomodated within the security housing. Also, either the threaded end or the headed end of the screw fastener can be accomodated in the bottom of the business machine to be secured, all as circumstances required. It is also an object of this invention to provide a security tie-down facility for machines which are not otherwise provided therewith, a depending bolt attachment as will be described.

This invention provides for controlled access to security means in the form of a screw fastener. Realizing that even the most secure device of this type can be defeated in time, it is an object of this invention to create difficulty for the would be thief, so as to buy time, when any attempt to defeat this security device is made. In other words, this invention establishes a delay in any tampering process such as lock picking or destruction of the security system as by sawing or the like. Accordingly, it is an object of this invention to render the security housing and the lock barrel closure therefor revolvable, so that a workable rotative position for picking or sawing is not readily attained. Also, the security housing is of truncated cone configuration with inclined sides which are not conducive to being grasped, especially in an awkward upsidedown position beneath a desk top. In practice, the securement housing rotates on the tie-down fastener, and the lock barrel rotates in the housing. And, the lock barrel substantially occupies the interior of the security housing, so that a penetrating saw or the like will strike the lock barrel rotatable therein and will rotate it without cutting the same.

It is an object of this invention to secure one or more machine modules that are required to be movable on the desk top. Accordingly, the security housing is attached over a cable loop that has a live end secured to the machine module, one or more thereof. In practice, the live cable end is permanently secured and attached to the underside of the machine or module by a pressure sensitive laminate of adhesive applied as may be required. The cable is flexible so that the machine module can be moved about.

SUMMARY OF THE INVENTION

This invention relates to the security of office machines against theft. The anti-theft system disclosed herein is a deterrent to theft, by making the act too time consuming for its completion. Although a thief might have the necessary tools to accomplish the act of theft, his act is rendered tedius and discouraging. To accomplish this end, I have provided a tie-down fastenter housing and lock barrel closure, all of which are feely rotatable and difficult to work with under adverse conditions. That is, without a key to facilitate operation of the device, substantial time would be consumed in order to defeat the system, during which time the thief runs the risk of being apprehended. In addition to the basic security housing and lock barrel that receives the tie-down fastener, attachment to the office machine can be by threaded screw engagement or by adhesive pad, and the tie-down can be fixed or movable as may be required.

The foregoing and various objects and features of this invention will be apparent and fully understood from the following detailed description of the typical preferred from and application thereof, throughout which description reference is made to the accompanying drawings:

Figure 1:
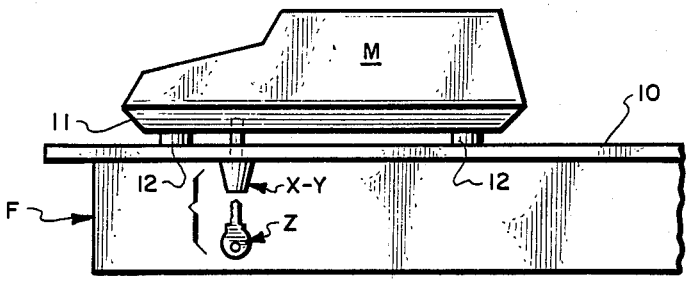
FIG. 1, is a side elevation of a typical business machine supported upon a desk top and secured thereto by the security system of the present invention.
Figure 2:
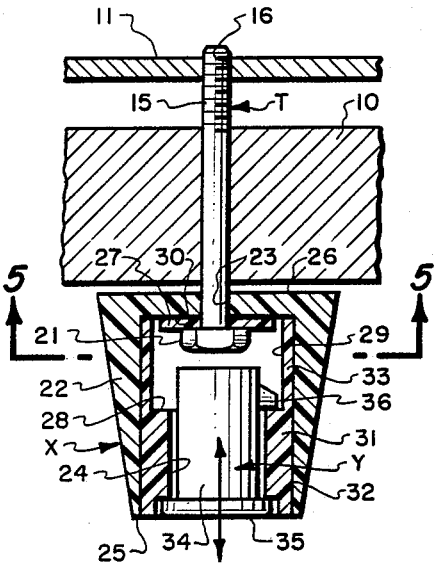
FIG. 2 is an enlarged detailed section view showing a first form of the invention, wherein the tiedown fastener is a cap screw threaded into the base of the machine.
Figure 3:
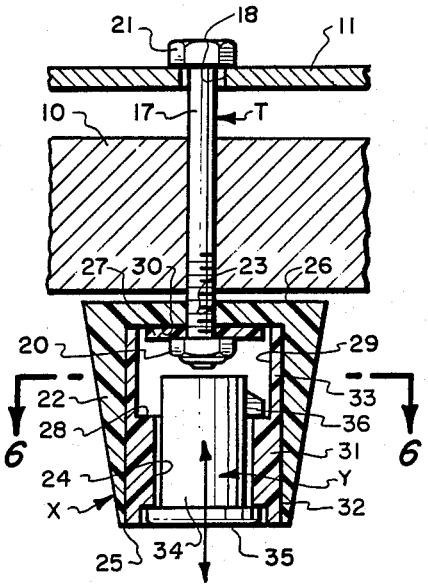
FIG. 3 is a view similar to FIG. 2 showing a second application of the security system of FIG. 1, wherein the tie-down fastener is a cap screw receiving a nut within the confines of the security housing that characterizes the security system.
Figure 4:
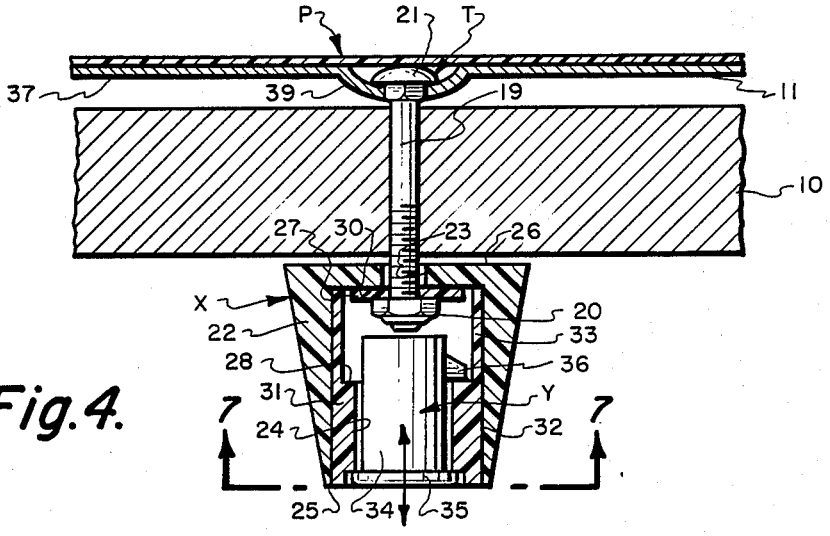
FIG. 4 is a view similar to FIGS. 2 and 3 and shows a third application of the security system of FIG. 1, wherein the tie-down fastener attachment to the machine is by means of a pressure sensitive laminate.
Figure 5:
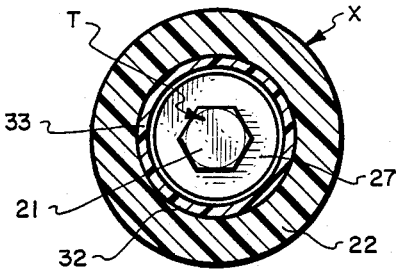
Figure 6:
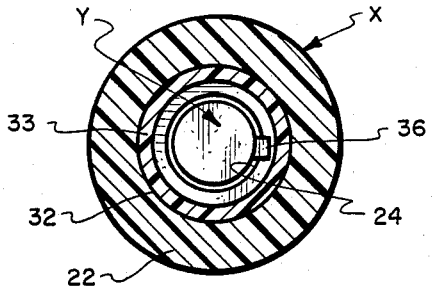
Figure 7:
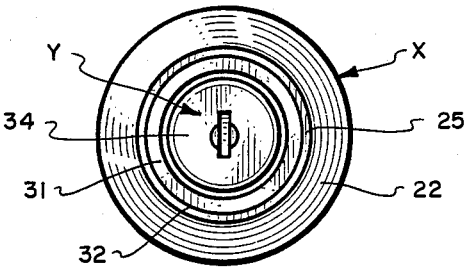

FIGS. 5, 6 and 7 are detailed section views taken as indicated by lines 5—5 on FIG. 2, 6—6 on FIG. 3, and 7—7 on FIG. 4.

Figure 8:
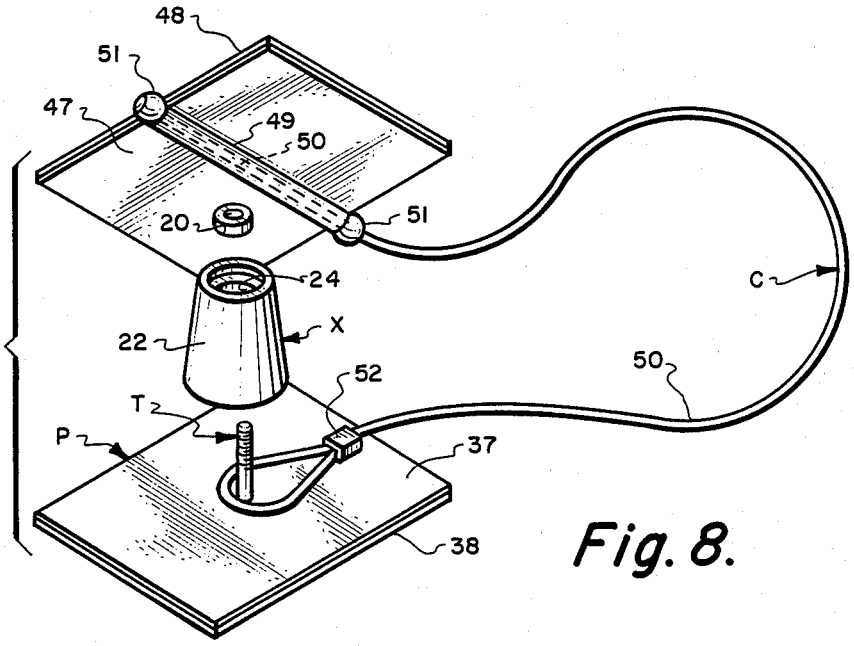

And, FIG. 8 is a perspective view of a fourth form of application, showing the additional feature of using pressure sensitive laminates to attach a cable and tie-down fastener.

PREFERRED EMBODIMENT

Referring now to the drawings, there is a machine M to be protectively secured to a piece of heavy furniture F such as to a desk top 10 on which the machine frame or bottom cover 11 thereof is supported upon legs or feet 12. The top 10 is horizontally disposed and the machine M remains in position (normally) by means of frictional engagement of the feet 12 with the top 10 through the force of gravity. Normally. such a machine can be lifted from its supported position, and it will be observed that I have provided hardware that attaches both the frame or bottom cover 11 of the machine M to the top 10 of the furniture F, a system which involves a tie-down fastener security housing X and a lock barrel closure Y therefor operated by a key Z. The security housing x is adapted to rotatably receive both the tie-down fastener T and the lock barrel closure Y, the latter being releasable with the key. When machine mobilityis required, then a flexible cable C connects the machine M to the tie-down fastener T as later described.

The tie-down fastener T provides the necessary connection for security and can be any suitable screw fastener or the like. For example, the fastener T can be a wood screw, a rivet, machine screw or bolt and nut; the type of head and/or nut being immaterial. As shown in FIG. 2, the tie-down fastener T is a cap screw 15 threaded into a tie-down facility opening 16 provided in the frame or bottom 11 of the machine M. As shown in FIG. 3, the tie-down fastener T is a bolt 17 dropped through a tie-down facility opening 18 provided in the frame or bottom 11 of the machine M. As shown in FIGS. 4 and 8, the tie-down fastener T is a carriage bolt 19 projecting from a securement pad P attached to the machine M or to the desk top 10 as may be required. The tie-down fastener T is either threaded into the machine M or into the desk top 10 (not shown), or it receives a nut 20 as shown in FIGS. 3,4 and in FIG. 8.

Referring now to the security housing X, this housing receives either the head 21 or nut 20 of the fastener T and encloses it for security. Accordingly, the housing X is comprised of a chambered body 22 with a fastener opening 23 and a closure opening 24. The opening 23 slideably and rotatably receives the fastener T, while the opening 24 slideably and rotatably receives the lock barrel closure Y. As shown, the body X is of truncated cone configuration, having a top closure end 25 smaller in diameter than a base end 26; the major diameter being approximately two inches and the height also approximately two inches. The interior of the body 22 is chambered to capture a washer 27 and to provide a lock shoulder 28.

In practice, the body 22 is injection molded of a plastic material such a Polycarbonate or Acrylic Butyl Styrene, in which case the washer 27 provides an anti-friction barrier to protect the softer plastic from being cut into by the harder metallic head of the fastener or the nut. The chamber in the body 22 is larger in diameter than the closure opening 24, the chamber being formed by an inner diameter wall 29 extending from the shoulder 28 to a bottom 30.

In practice, the chamber in the body is formed by a plug 31 of cylinder form having an outer diameter wall 32 pressed into the body 22 and solvent welded (when made of plastic). The plug 31 has a sleeve portion 33 that extends from the shoulder 28 to stop against the bottom 30, the inner diameter wall 29 having clearance around the washer 27 which is captured within the chamber when the body 22 is assembled as shown.

Referring now to the lock barrel closure Y, a top quality lock barrel of shouldered cylinder configuration is employed. The lock barrel 34 is about three quarters of an inch in diameter so as to slide freely into the closure opening 24, and it has a peripheral flange 35 at its outer end and a retractile dog 36 projecting radially from its inner end side portion. the dog 36 is operated by the key Z that actuates state of the art tumblers, to releasably engage with the lock shoulder 28 in body 22. As shown, the inner end portion of the lock barrel 34 enters into the chamber in body 22 and stops short of the end of fastener T and/or the head 21 thereof or nut carried thereby.

Referring to FIG. 2 of the drawings, the tie-down facility opening 16 is threaded to receive the cap screw 15 passed through an opening bored through the table top 10. The head 21 of the cap screw 16 is brought up to the bottom 30 or to the washer 27, by using a socket wrench with an extension. As hereinabove stated, the security housing X rotates when installed in working condition, in which case a thread locking compound or the like is applied at the threaded engagement in opening 16, and after engagement of the head 21 with washer 27 the fastener T is backed off a part turn, at least until it is frictionally free to permit rotation of the security housing X. The security assembly is completed by installing the lock barrel closure Y, extending the dog 36 to engage lock shoulder 28 using the lock key Z.

Referring to FIG. 3 of the drawings, the tie-down facility opening 18 is bored to freely pass the bolt 17 which is passed therethrough and through an opening bored through the table top 10. The head 21 of the bolt bears upon the top side of frame or bottom 11, and the threaded end portion thereof enters into the chamber within the security housing X. The nut 20 is applied and brought up to the bottom 30 or the washer 27, by using a socket wrench with an extension. As hereinabove stated, the security housing X rotates when installed in working condition, in which case a state of the art self locking nut 20 is employed, and after engagement of the nut 20 with washer 27 the nut is backed off a part turn, at least until it is frictionally free to permit rotation of the security housing X. The lock barrel closure is then applied as above described.

Referring to FIG. 4 of the drawings, there is no tie-down facility provided for in the machine M shown, in which case the securement pad P is provided to mount the carriage bolt 19 so that it projects downwardly from the frame or bottom 11 of the machine. As shown, anchor means comprised of a laminate 37 of metal, preferably steel sheet, and a layer 38 of double backed pressure sensitive plastic sheet material is formed with a socket 39 having a polygonal opening to receive the carriage bolt head 21 and prevent turning thereof, and so that the threaded end of the carriage bolt projects downwardly from the machine M when the laminate is pressed onto the frame or bottom 11 as shown. In practice, state of the art pressure sensitive adhesive sheet has a holding capability in tension of 300 pounds per square inch, and the pad thereof as used herein is approximately twenty four square inches in area. Therefore, the holding power of this anchor means is substantial. The threaded end portion of the carriage bolt 19 enters into the chamber within the security housing X. The nut 20 is applied and brought up to the bottom 30 or the washer 27, by using a socket wrench with an extension. As hereinabove stated, the security housing X rotates when installed in working condition, in which case a state of the art self locking nut 20 is employed, and after engagement of the nut 20 with washer 27 the nut is backed off a part turn, at least until it is frictionally free to permit rotation of the security housing X. The lock barrel closure is then applied as above described.

Referring to FIG. 8 of the drawings, the cable C securement means is employed so as to permit mobility of the machine M. As shown, anchor means comprised of a laminate 47 of metal, preferably steel sheet, and a layer 48 of double backed pressure sensitive plastic sheet material is formed with a channel 49 open at opposite edges of the metal laminate to pass a flexible cable 50 with swaged fittings 51 affixed thereon adjacent each edge. In practice, a ⅛ inch 7×19 stainless steel cable is employed with a looped end also secured by a swage fitting 52. The looped live end of the cable is engaged over the fastener T passed through the table top 10, or to a fastener T anchored to the laminate 37 and layer 38 of double backed pressure sensitive plastic sheet, all as hereinabove described with reference to FIG. 4. The securement fastener T is applied with a nut 20, and the lock barrel closure then applied, all hereinabove described.

From the foregoing it will be seen that I have provided a relatively simple two part device, comprised of the security housing X and the lock barrel closure Y, operable by a key Z. To defeat this security system in any of its applications as disclosed generally herein, is difficult and time consuming, especially under adverse conditions and not knowing exactly what to expect. Not only does the lock barrel turn freely in the security housing, but the housing also turns freely on the tie-down fastener. However, turning of the key Z is a simple matter when it is previously known that the barrel must be held from turning when the key is operated.

Having described only type typical preferred forms and applications of my invention, I do not wish to be limited or restricted to the specific details herein set forth, but wish to reserve to myelf any modifications or variations that may appear to those skilled in the art as set forth within the limits of the following claims.

I claim:

1. A security system that discourages the theft of office machines mounted on the top of furniture having a flat lower surface comprising in combination:

an elongated fastener comprising a rod having a first end including attachment means to attach the first end to the base of the machine, said rod having a length sufficient to extend through a hole in said top of the furniture and including a second end;

a cap having a wider diameter than the rod and the hole in the top attached to the second end of the rod for securing the machine to the top;

a hollow housing surrounding said cap having a chamber, said housing including a flat upper wall, a downwardly extending side wall connected to the upper wall and having an open lower end, said flat upper wall engaging the flat lower surface of the top and having an aperture for receiving the second end of said rod and being rotatably mounted on said rod between the cap and the lower surface of the furniture top;

a lock closure means including a lock barrel having a retractable latch, said lock barrel being releasably and rotatably secured in the lower open end of said housing with the lock barrel spaced from said cap and being independent of the cap fastener; and the inner surface of the side wall of the housing containing a continuous, horizontal rim disposed in a position to slidingly engage the bottom surface of the latch whereby said lock barrel is rotatable throughout 360 degrees in said housing.

2. A security system according to claim 1 in which the attachment means includes threads formed on said first end for connection to a threaded aperture in the base of the machine.

3. A security system according to claim 1 in which the attachment means includes threads formed on said first end for connection to a threaded aperture in the base of the machine.

4. A security system according to claim 1 in which the attachment means includes a plate secured to the first end of the rod and an adhesive layer is disposed on the top surface of the plate for adhering to the base of the machine.

5. A security system according to claim 2 in which the cap includes a bolt head.

6. A security system according to claim 3 in which the cap includes threads formed on the second end of the rod and a nut received on said threads.

7. A security system according to claim 6 in which the nut is a self-locking nut.

8. A security system according to claim 1 further including an auxiliary theft protector comprising a pad for connection to an auxiliary device, a loop connected to the rod and a flexible cable connecting the loop to the pad.

9. A security system according to claim 8 in which the pad contains an adhesive layer for connection to the auxiliary device.

10. A device according to claim 7 in which the lock barrel latch is retractable on insertion of a key.

11. A device according to claim 1 further including a metal washer positioned between the cap and the inside surface of the upper wall of the housing.

12. A device according to claim 1 in which the housing is formed of plastic.

13. A device according to claim 12 in which the side wall of the housing has a conical configuration.

* * * * *